United States Patent [19]

Shimoyama

[11] Patent Number: 4,752,661

[45] Date of Patent: Jun. 21, 1988

[54] SWITCH DEVICE OF THE SWING TYPE

[75] Inventor: Yujiro Shimoyama, Furukawa, Japan

[73] Assignee: Alps Electric Co., Ltd., Japan

[21] Appl. No.: 28,680

[22] Filed: Mar. 20, 1987

[30] Foreign Application Priority Data

Aug. 7, 1986 [JP] Japan ..... 61-120382[U]

[51] Int. Cl.[4] ..... H01H 23/02

[52] U.S. Cl. ..... 200/339

[58] Field of Search ..... 200/339; 384/439, 428, 384/539; 248/251; 403/119, 26

[56] References Cited

U.S. PATENT DOCUMENTS

| | | | |
|---|---|---|---|
| 3,178,530 | 4/1965 | Lawson | 200/339 |
| 3,501,599 | 3/1970 | Horecky | 200/339 |
| 3,681,556 | 8/1972 | Osika | 200/339 |
| 4,045,650 | 8/1977 | Nestor | 200/339 |
| 4,081,643 | 3/1978 | Kuo | 200/339 |

*Primary Examiner*—Renee S. Luebke

*Attorney, Agent, or Firm*—Guy W. Shoup

[57] ABSTRACT

A switch device of the swing type comprising snap hooks provided with a slit extending from the foremost end to the base thereof, a part of the slit being made wider to form a bearing portion; a shaft fitted into the bearing portion in the snap hooks; and an operation piece freely swingable round the shaft. A stopper is arranged, adjacent and parallel to the snap hooks to stop the relative movement of the shaft toward the base of the snap hooks. The shaft cannot be pressed into a narrower portion of the slit which extends downward from the bearing portion thereof, thereby preventing the snap hooks from being spread out and broken.

2 Claims, 2 Drawing Sheets

SWITCH DEVICE OF THE SWING TYPE

BACKGROUND OF THE INVENTION (a) Field of the Invention

The present invention relates to a switch device of the swing type such as the seesaw and toggle switches wherein their operation pieces are swung to achieve on- and off-operations.

(b) Prior Art

FIGS. 3 and 4 show one of the conventional seesaw switches, in which FIG. 3 is a plan view and FIG. 4 is a sectional view taken along a line A—A in FIG. 3.

A pair of snap hooks 2 which are separated by a certain distance from each other are projected from a synthetic resin case 1. A shaft 5 of an operation piece 4 is held in a slit 3 of the snap hooks 2, keeping the operation piece 4 freely swingable in directions B in FIG. 4. The snap hooks 2 have slight resiliency because the slit 3 extends from the foremost end to the base of the snap hooks 2, and when the shaft 5 is pushed into the slit 3 through the foremost end of the snap hooks 2, it is held in a bearing portion 3a where the slit 3 is made wider. When the operation piece 4 is pushed by a finger 6 or the like on the right or left side thereof, therefore, it is pivoted on the shaft 5, enabling the switch to be turned on and off.

In the case of the switch device of this swing type, the operation peice 4 may be eroneously pushed by the finger on the center thereof, and when strong force is directed downward in a direction C in FIG. 4, the shaft 5 is pressed into a narrower portion of the slit 3 extending downward from the bearing portion 3*a* thereof, thereby causing the synthetic resin snap hooks 2 to be spread out and broken under some circumstances.

SUMMARY OF THE INVENTION

The present invention is therefore provided to eliminate the above-mentioned drawback. Accordingly, the object of the present invention is to provide a switch device of the swing type wherein the snap hooks can be kept unbroken.

The object of the present invention can be achieved by a switch device of the swing type comprising snap hooks provided with a slit extending from the foremost end toward the base thereof, a part of said slit being made wider to form a bearing portion, a shaft fitted into the bearing portion of the snap hooks, and an operation piece pivotable with the shaft, wherein a stopper is arranged in the neighborhood of the snap hooks to stop the shaft from moving to the base of the snap hooks.

Even when any force is added to push the shaft, on which the operation piece is pivoted, toward the base of the snap hooks, the shaft is stopped by the stopper, thereby preventing the shaft from being further pressed into a narrower portion of the slit extending downward from the bearing portion thereof.

BRIEF DESCRIPTION OF THE DRAWINGS

FIGS. 1 and 2 are intended to explain an embodiment of the present invention, in which FIG. 1 is a sectional view showing a seesaw switch viewed from its operation piece side and FIG. 2 a side sectional view showing a main portion of the seesaw switch.

FIGS. 3 and 4 are intended to explain a conventional example, in which FIG. 3 is a plan view showing a seesaw switch and FIG. 4 a sectional view showing the seesaw switch viewed from its operation piece side.

DETAILED DESCRIPTION OF THE PREFERRED EMBODIMENT

An embodiment of the present invention will be described referring to FIGS. 1 and 2.

Figure 1:
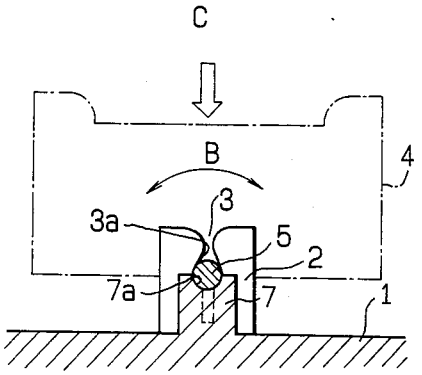
Figure 2:
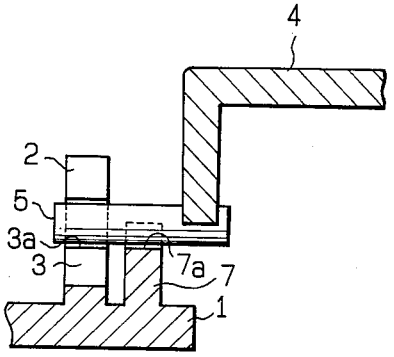
Figure 3:
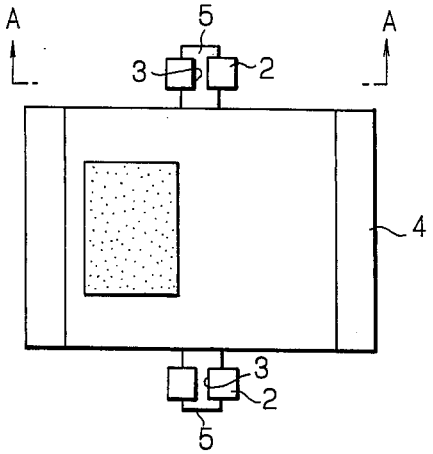
FIG. 3 PRIOR ART
Figure 4:
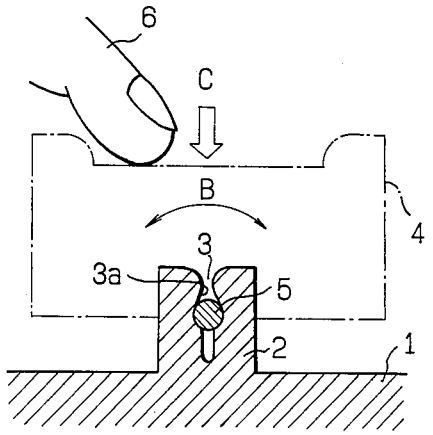
FIG. 4 PRIOR ART

FIG. 1 is a sectional view showing a seesaw switch of the present invention viewed from its operation piece side and FIG. 2 a side sectional view showing a main portion of the seesaw switch. The same parts as those shown in FIGS. 3 and 4 will be denoted by same numerals and description on these parts will be omitted.

In FIGS. 1 and 2, snap hooks 2 and a stopper 7 are projected, adjacent and substantially parallel to each other, from a synthetic resin case 1 and the stopper 7 is provided with an arc recess 7*a* on the top thereof. The recess 7*a* is the same in its curving rate and its height from the case 1 as a bearing portion 3*a* where a part of a slit in the snap hooks 2 is made wider. A shaft 5 of an operation piece 4 is held, freely rotatable, on the bearing portion 3*a* and recess 7*a*. The operation piece 4 is pivoted on the shaft 5 in directions B, causing the switch to be turned on and off. Although not shown, another pair of snap hooks 2 is arranged on the other side of the operation piece 4 and another stopper is positioned inside the snap hooks 2.

When the operation piece 4 is pushed on the center thereof to add force in a direction C, the shaft 5 is also pushed in the same direction but it cannot be moved further to the base of the snap hooks 2 because it is supported by the stopper 7 which has no slit. Therefore, the shaft 5 cannot be pressed into a narrower portion of the slit 3 which extends downward from the bearing portion 3*a* thereof, thereby preventing the snap hooks 2 from being broken.

The fact that the recess 7*a* of the stopper 7 is on a same level, having a same curving rate as that of the bearing portion 3*a* in the snap hooks 2, means that the structure of a die for forming both of the recess 7*a* and bearing portion 3*a* can be made simpler, which is more advantageous in cost.

Although a shaft integral to the operation piece is held by snap hooks integral to the case in the case of the above-described switch device, the shaft may instead be integral to the case and fitted into the bearing portion of snap hooks formed integrally with the operation piece. The stoppers are arranged on the side of the operation piece in this case.

According to the present invention as described above, the further relative movement of the shaft toward the base of the snap hooks can be stopped by the stopper even when force is added to push the shaft, on which the operation piece is pivoted, in this direction. The shaft can be thus prevented from being further pressed into the narrower portion of the slit which extends downward from the bearing portion thereof, thereby preventing the snap hooks from being spread out and broken.

I claim:

1. A switch device comprising:

a base extending in a horizontal direction;

an opertion piece mounted on the base so as to be pivotable in one or the other rotational directions of an axis parallel to the horizontal direction of the base;

snap engaging means including a shaft rotatable on an axis extending in the horizontal direction for mounting the operation piece pivotably on the base, and a pair of snap hooks spaced apart from each other in the horizontal direction, each snap hook being formed with a slit extending in a vertical direction, wherein each slit has narrow upper and lower slit portions and a wider bearing portion intermediate the upper and lower slit portions, and the shaft has ends extending on opposite sides of the operation piece which are snap mounted resiliently through the upper or lower slit portions into the respective bearing portions of the pair of snap hooks, said pair of snap hooks being provided on one of said base or said operation piece and said shaft being provided on the other thereof; and a pair of stoppers each disposed along the shaft axis adjacent a respective one of said snap hooks and having a stopper surface formed in parallel with the bearing portion of the corresponding snap hook, for preventing the corresponding ends of the shaft mounted in the bearing portions from being pressed into the narrow upper of lower slit portions of the snap hooks by a vertical force applied on the operation piece.

2. A switch device according to claim 1, wherein said bearing portions of said snap hooks have curved bearing surfaces, and said stopper surfaces are correspondingly curved in parallel with the curvature of the bearing surfaces.

* * * * *

UNITED STATES PATENT AND TRADEMARK OFFICE

CERTIFICATE OF CORRECTION

PATENT NO. : 4,752,661

DATED : June 21, 1988

INVENTOR(S) : YUJIRO SHIMOYAMA

It is certified that error appears in the above-identified patent and that said Letters Patent is hereby corrected as shown below:

Claim 1, col. 4, line 7, change "of" to --or--.

Signed and Sealed this

Twentieth Day of December, 1988

*Attest:*

DONALD J. QUIGG

*Attesting Officer*

*Commissioner of Patents and Trademarks*